US008222553B2

(12) United States Patent
Zieder

(10) Patent No.: US 8,222,553 B2
(45) Date of Patent: Jul. 17, 2012

(54) METAL DOMED CONTACT COMPONENT AND CARD COMPRISING IT

(75) Inventor: David Zieder, Sciez (FR)

(73) Assignee: Nicomatic SA, Bons en Chablais (FR)

( * ) Notice: Subject to any disclaimer, the term of this patent is extended or adjusted under 35 U.S.C. 154(b) by 508 days.

(21) Appl. No.: 12/444,329

(22) PCT Filed: Oct. 2, 2007

(86) PCT No.: PCT/FR2007/001606

§ 371 (c)(1),
(2), (4) Date: Apr. 3, 2009

(87) PCT Pub. No.: WO2008/043896

PCT Pub. Date: Apr. 17, 2008

(65) Prior Publication Data

US 2010/0012473 A1 Jan. 21, 2010

(30) Foreign Application Priority Data

Oct. 6, 2006 (FR) ..... 06 08799

(51) Int. Cl.
*H01H 5/30* (2006.01)

(52) U.S. Cl. ..... 200/406

(58) Field of Classification Search ..... 200/406, 200/516, 238, 239, 243, 275, 278, 279
See application file for complete search history.

(56) References Cited

U.S. PATENT DOCUMENTS

| | | | | |
|---|---|---|---|---|
| 3,133,170 | A * | 5/1964 | Nanninga | 200/406 |
| 3,697,711 | A * | 10/1972 | Tetrick | 200/406 |
| 3,996,428 | A * | 12/1976 | Buan et al. | 200/5 A |
| 4,296,283 | A * | 10/1981 | Koenig et al. | 200/16 D |
| 5,898,147 | A * | 4/1999 | Domzalski et al. | 200/1 B |
| 6,858,811 | B2 * | 2/2005 | Fitzgerald et al. | 200/85 R |
| 6,946,610 | B2 * | 9/2005 | Takeuchi et al. | 200/406 |
| 7,199,321 | B1 * | 4/2007 | Huang | 200/406 |
| 7,301,113 | B2 * | 11/2007 | Nishimura et al. | 200/406 |
| 7,429,707 | B2 * | 9/2008 | Yanai et al. | 200/1 B |
| 7,557,320 | B1 * | 7/2009 | Crooijmans et al. | 200/406 |
| 2004/0055860 | A1 * | 3/2004 | Huseman et al. | 200/406 |
| 2004/0256211 | A1 * | 12/2004 | Chen | 200/406 |
| 2005/0199475 | A1 | 9/2005 | Kawakubo | |
| 2006/0187040 | A1 * | 8/2006 | Sweeney | 340/572.1 |

FOREIGN PATENT DOCUMENTS

| | | |
|---|---|---|
| JP | 11 232 962 A | 9/1999 |
| WO | WO 01 48 770 A | 7/2001 |

OTHER PUBLICATIONS

PCT Search Report of the ISA dated Mar. 18, 2008 for PCT/FR2007/001606 filed on Apr. 1, 2008.

* cited by examiner

*Primary Examiner* — Michael Friedhofer
(74) *Attorney, Agent, or Firm* — Daly, Crowley, Mofford & Durkee, LLP

(57) ABSTRACT

The invention relates to a domed contact component controlled by mechanical activation, which comprises an outer static conducting member (10), an inner static conducting member (12) and a resilient metal contact dome (18) which is in constant and static contact with the outer static conducting member (10). The dome (18) has a central contact part and a linking part, the periphery of which is electrically connected and mechanically linked to the outer static conducting member (10). The linking part comprises arms (22) having a portion (26) with elastic properties in the radial direction, and a stud (24) for fastening the outer static conducting member. Application to bank cards provided with keys.

16 Claims, 2 Drawing Sheets

FIG.4
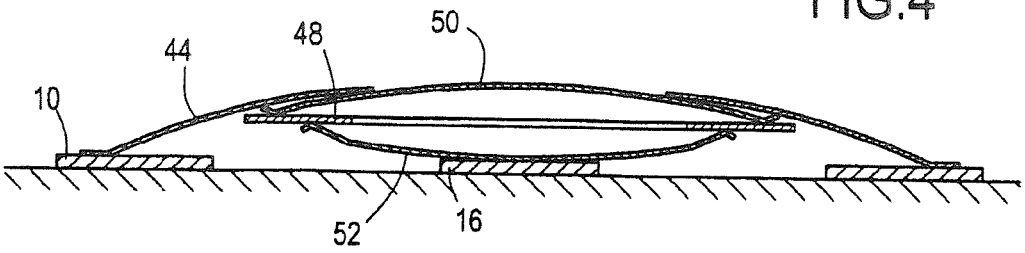
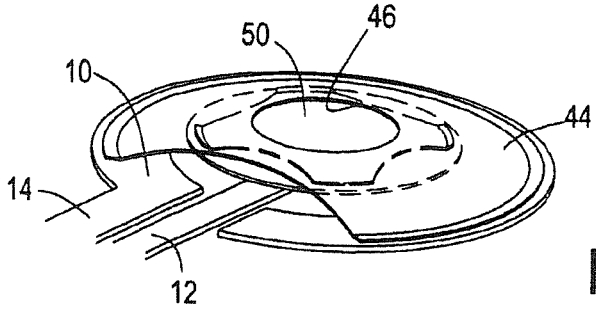
FIG.5
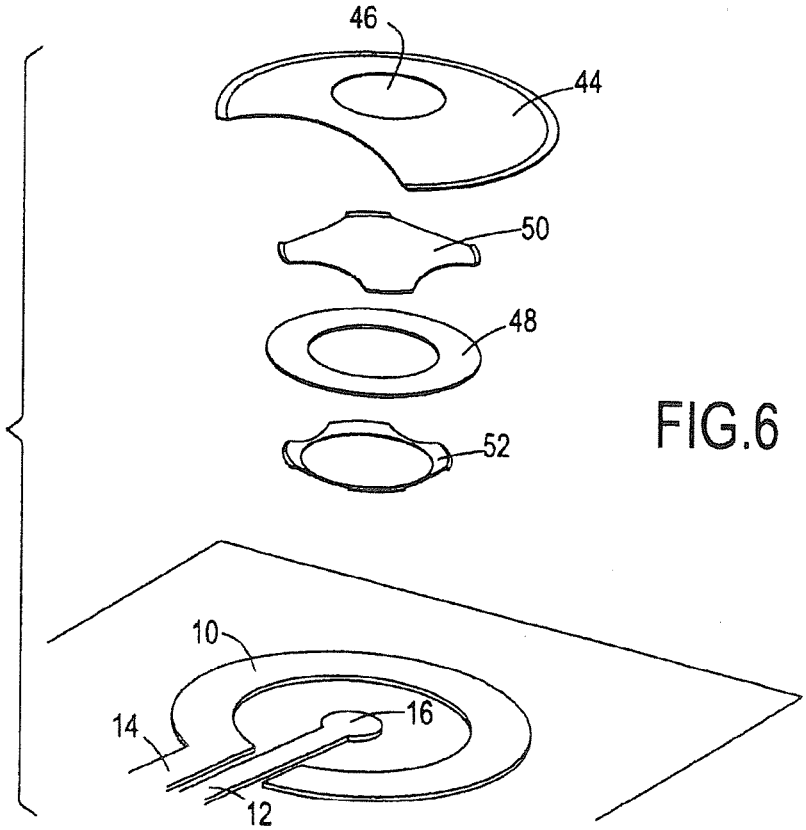
FIG.6

METAL DOMED CONTACT COMPONENT AND CARD COMPRISING IT

CROSS REFERENCE TO RELATED APPLICATIONS

This application claims the benefit of International Patent Application PCT/FR2007/001606 filed Oct. 2, 2007, published in the French language as WO2008/043896, which application claims priority from French application number 0608799, filed Oct. 6, 2006.

The present invention relates to a contact component intended to establish electrical continuity between two conductor elements when it is subjected to a mechanical activation, for example by a finger, and a card comprising at least one such component.

Although the invention is described with reference to particular applications, the contact components according to the invention are suited to conventional applications of dome contacts, which for example are fitted by positioning machines known as pick-and-place machines.

For various security, electronic banking, etc. applications it is desirable to incorporate contact components into supports of low thickness, similar to bank cards. It is known that metal domes constitute particularly advantageous elements as they provide a tactile effect to the person operating them, as described in the following with reference to FIG. 1. It has therefore been attempted to incorporate such domed conductor components into cards of low thickness.

It has thus been attempted to use metal domes intended to establish a contact between two static conductor elements, formed by printing on a support, the dome then being covered by an element in sheet form. It has been realized that such a contact did not have the necessary reliability. This shortcoming was attributed to the movement of the outer parts of the dome when this is being operated. Specifically, these movable outer parts, as they are metal, cause abrasion of the plastic of the covering sheet.

Provision has therefore been made to cover such domes with a static protective element. Such a protective element has the disadvantage, however, of increasing the size of the component and therefore practically preventing the use of the domes in the case of thin cards.

The invention relates to the solution of this problem. More precisely, it relates to the use of a metal contact dome, but in such a way that the circumference of the dome does not move during the mechanical activation of the contact component, for example by a finger. This feature is obtained because at its outermost part the dome is fixed to an outer static conductor element and has elasticity between the central part and this fixed part.

More precisely, the invention relates to a contact component intended to establish electrical continuity under the effect of a mechanical activation and to cancel this continuity elastically in the absence of the mechanical activation; according to the invention, the component comprises an outer static conductor element, an inner static conductor element, and a springy metal contact dome intended to connect the static conductor elements temporarily, the dome being in constant and static contact with the outer static conductor element, being fixed to this outer static conductor element.

In one embodiment, the dome comprises a central contact part and a connecting part, the periphery of which is electrically connected and mechanically joined to the outer static conductor element.

The connecting part preferably comprises at least three arms extending radially from a domed central contact part, and each of the three arms comprises successively, from the central area of contact, a section having elastic properties in the radial direction, and a contact block for fixing to the outer static conductor element.

In another embodiment, the dome consists of two parts comprising a conventional dome and a cap forming the connecting part and having a central opening.

Preferably, it comprises two domes, positioned on either side of an insulating annular spacer which insulates the outer peripheral parts of the domes from one another, the central parts of the two domes being distant in the rest position of the domes and in contact in their mechanically activated position.

In another embodiment, the dome comprises a domed central contact part, a peripheral part fixed in electrical contact with the outer static conductor element and, between the central part and the peripheral part, an intermediate part joined to the central part and to the peripheral part at locations offset along the circumference of the intermediate part.

Preferably, the dome is circular in shape, the central part is a circle shape, and the peripheral and intermediate parts are a ring shape, the ring of the intermediate part being connected alternately to the central part and to the peripheral part in the circumferential direction.

The dome preferably consists of a single piece cut from a sheet.

The constant and static contact of the dome with the outer static conductor element is preferably produced by soldering.

The outer static conductor element and the inner static conductor element are preferably both formed by printing on an insulating support.

The invention also relates to a card with a contact component intended to be activated mechanically by applying pressure in the direction of the thickness, comprising a support provided with an outer static conductor element and an inner static conductor element which are not electrically connected, and a springy metal contact dome which is in constant and static contact with the outer static conductor element, and a coating placed over the support around the component and over the component directly in contact with the dome.

Further features and advantages of the invention will be understood better on reading the following description of exemplary embodiments, with reference to the appended drawings, in which:

FIGS. 4, 5 and 6 show a contact component according to a third embodiment of the invention in cross section, in perspective and in an exploded view respectively.

Figure 1:
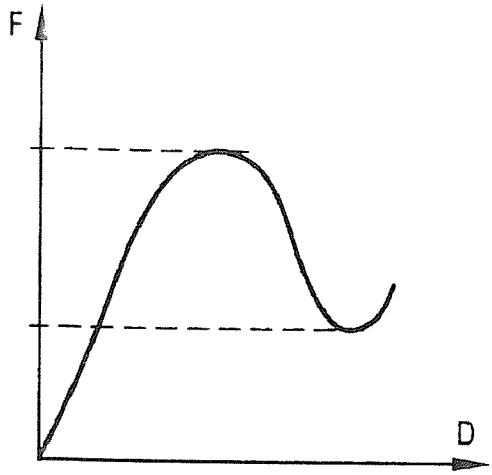
FIG. 1 is a graph indicating why domes are advantageous as finger-operated contacts.

FIG. 1, which represents the force F that is applied to the center of a metal contact dome on the y-axis and the movement of the central part of the dome relative to its rest position on the x-axis, note that the force applied increases up to a maximum value, then falls quickly to reach a final contact force less than the maximum value. As a consequence, the finger that exerts this force in the form of a pressure feels a reduction in force due to the flipping of the dome and therefore has a tactile sensation which indicates that the contact has actually been made. This is the reason it is desirable to use contact components having a metal dome even in cards of very low thickness, such as cards in the format of bank cards and the thickness of which may be less than 0.8 mm.

Figure 2:
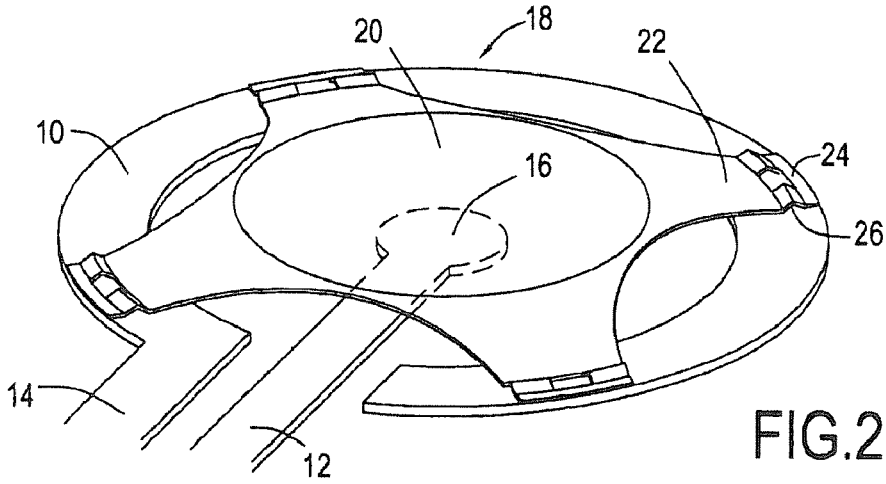
FIG. 2 is a perspective view of a contact component according to a first embodiment of the invention.

FIG. 2 shows a contact component according to a first embodiment of the invention in perspective.

In FIG. 2, the reference 10 denotes an outer static conductor element of circular shape over around 315°, having a conductive track 14 enabling connection to a circuit (not shown). An inner static conductor element 12 has a central contact area 16.

The two static conductor elements 10 and 12 are formed, for example, by printing on an insulating support, such as a sheet of plastic.

The component also comprises a metal dome 18 according to the invention. This dome comprises a domed central part 20 located above the contact area 16, and four radial arms 22 (the number of arms is equal to at least three).

According to the invention, each radial arm 22 comprises, at its outer end, a conductive contact block 24 to which it is connected by an elastic intermediate part 26.

According to the invention, the contact block 24 of the corresponding arm 22 is fixed to the static conductor element 10, for example by soldering. The intermediate part 26 has elastic properties that are provided to it, in the example shown, by reducing the width of the arm through a central opening defining two bridging pieces folded in a V. This elasticity allows radial movement of each arm 22 when the central part 20 is pushed towards the conductive area 16.

Thus, the part of each arm 22 which is furthest from the center, i.e. the contact block 24, does not move at all, radially or otherwise, when the contact component is being operated. It therefore remains in permanent contact with the outer track 10 whatever the mode of operation of the dome. Conversely, thanks to the elastic parts 26 of the arms, the dome 18 is able to operate normally, i.e. its central domed part 20 is able to come into contact with the conductive area 16 under the action of a pressure and is then able to move away from it elastically.

The radial movements of the arms are greatest at the connection of the elastic part 26 and of the body of the arm 22 connected to the central part. However, even through these movements cause abrasion of a plastic sheet positioned above, this abrasion has no effect on the contact itself as the latter takes place further on, at the contact block 24.

FIG. 2 shows an example of a metal dome provided with arms. There are other types of dome, especially circular shaped domes. The embodiment of FIG. 3 corresponds to such a dome.

Figure 3:
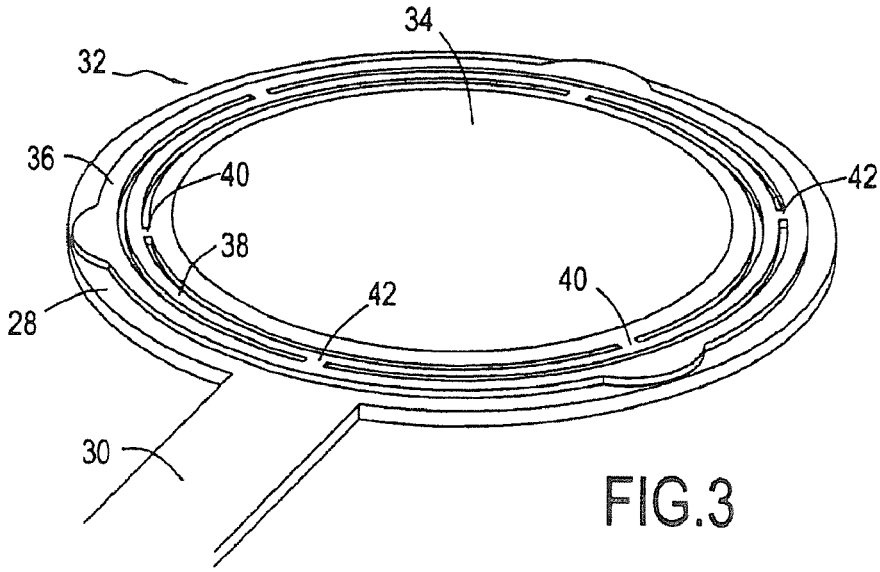
FIG. 3 shows a contact component according to a second embodiment of the invention.

In FIG. 3 an outer static conductor element 28 having a conductive track 30 for connection to an electrical circuit (not shown) is positioned on the largest part of a circle. Although it is not shown, the component also comprises an inner static conductor element, as in the case of FIG. 2.

The circular dome 32 is formed in a single piece by cutting from a metal sheet, and it has a domed central part 34, an outer ring 36 and an intermediate ring 38. Circularly arcuate cut-outs in a circular arc separating the outer ring from the intermediate ring and the intermediate ring from the central part, covering an angle a little less than 120°, leave conductive bridging pieces between them. Thus, they leave conductive bridging pieces 40 connecting the central part 34 to the intermediate part 38 at three locations offset by 120°. Similarly, they leave conductive bridging pieces 42 between the outer ring 36 and the intermediate ring 38, these bridging pieces 42 being angularly offset by 60° practically relative to the bridging pieces 40.

As in the embodiment of FIG. 2, the outer ring 36 is fixed, for example by soldering, to the outer static conductor element 28, either over the largest part of the periphery or only at the contact areas represented schematically by protrusions of the outer ring 36. Thanks to the circularly arcuate cut-outs in a circular arc, the connection between the central part 34 and the outer ring 36 is very flexible, so that the metal dome 32 may have a mode of operation practically identical to that of a free circular metal dome.

The embodiment of FIG. 3 has the same advantages as that of FIG. 2.

The embodiments shown in FIGS. 2 and 3 enable the formation of a contact component that comprises only one printed conductor, comprising two static conductor elements, one outer and the other inner, and a dome 18, 32. The number of components is therefore reduced to the extreme and the component cost is itself also greatly reduced.

The components described with reference to FIGS. 2 and 3 are especially suitable for relatively rigid supports, in which the actuation force is exerted from one side of the component. In the case of flexible cards it is desirable for the component to be operated by tightening two pinching members, for example the thumb and index finger of a user. The embodiment of FIGS. 4 to 6 is particularly suitable for this application.

FIGS. 4 to 6 show a contact component according to the invention according to a third embodiment comprising a greater number of components. More precisely, if constraints of flexibility of the support or of activation travel require it, it may be advantageous to use this component in which each of two domes constitutes a support for the other dome.

The component of the embodiment of FIGS. 4 to 6 may be made with a very small size and great operating reliability.

This component comprises an outer static conductor element 10 having a conductive connection track 14 and an inner static conductor element 12 having a contact area 16, both formed on an insulating sheet, made of plastic for example, as in the first embodiment.

A flexible conductor element 44, for example in the form of a cap, is fixed on an extended part of the outer static conductor element 10, in electrical contact with it. This element 44 has a central opening 46.

An insulating spacer 48, in the form of a simple ring, is positioned between two metal domes 50, 52 shown as being identical, but the arms of which are rotationally offset.

The conductor element 44 is in electrical contact with the dome 50. It therefore constitutes a connecting element between the dome 50 and the conductor element 10. It may optionally be fixed at points by bonding or soldering to the edge of the opening 46 of the conductor element 44 in order to ensure electrical continuity. This soldering is not, however, indispensable. The conventional dome 50 and the conductor element 44 together form a single "metal dome according to the invention" having the function of forming a static contact with the outer static conductor element 10. In the mechanically activated position, the central part of the dome 50 is connected to the inner static conductor element 16 by means of the dome 52.

As FIG. 4 indicates, in the rest position of the contact component the lower metal dome 52 bears on the lower static conductor element consisting of the contact area 16 and its arms are in contact with the insulating ring 48. The dome 50 is also in contact with the ring 48, on the other side, so that there is no electrical continuity between the two domes 50, 52. The dome 50 is electrically connected to the outer static conductor element 10 by the conductor element 44.

When the component is operated by applying a force, the travel of the element that exerts the mechanical activation, in general a finger, is equal to the sum of the travels of the two domes.

Although the embodiment of FIGS. 4 to 6 has been described with reference to domes with radial arms, it is also possible to use circular domes.

Although it has been indicated that the upper dome 50 was connected to the outer static conductor element by the conductor element 44, it will be understood that it is possible to provide the dome 50 with radial arms having a function similar to that of the arms of the embodiment of FIG. 2, i.e. comprising an elastic connecting part.

The invention claimed is:

1. A contact component intended to establish electrical continuity under the effect of a mechanical activation and to cancel this continuity elastically in the absence of the mechanical activation, comprising:

an outer static conductor element;

an inner static conductor element; and a springy metal contact dome intended to connect the static conductor elements temporarily, the dome being in constant and static contact with the outer static conductor element, being fixed to this outer static conductor element, wherein the dome comprises a domed central contact part, a peripheral part electrically connected and mechanically joined to the outer static conductor element and, between the central part and the peripheral part, an intermediate part joined to the central part and to the peripheral part at locations offset along the circumference of the intermediate part.

2. The component as claimed in claim 1, characterized in that the dome is circular in shape, the central part is a circle shape, and the peripheral and intermediate parts are a ring shape, the ring of the intermediate part being connected alternately to the central part and to the peripheral part in the circumferential direction.

3. The component as claimed in claim 1 wherein the dome comprises a single piece cut from a sheet.

4. The component as claimed in claim 1, characterized in that a constant and static contact of the dome with the outer static conductor element is produced by soldering.

5. The component as claimed in claim 1 wherein the outer static conductor element and the inner static conductor element are both formed by printing on an insulating support.

6. The contact component as recited in claim 1 wherein said dome has a circular shape and the central portion of said dome is disposed over said inner static conductor element.

7. The contact component as recited in claim 1, wherein:

said dome has a circular shape;

the central portion of said dome has a circular shape; and said outer static conductor element has a ring shape.

8. The contact component as recited in claim 7 wherein said outer ring-shaped static conductor element has an opening therein and said inner static conductor element passes through the opening and terminates in a central portion of said outer ring-shaped static conductor element.

9. A card with a contact component having a thickness, the contact intended to be activated mechanically by applying pressure in the direction of the thickness, the contact component comprising:

a support provided with an outer static conductor element and an inner static conductor element which are not electrically connected; and a springy metal contact dome which is in constant and static contact with the outer static conductor element, said dome comprising a domed central contact part, a peripheral part electrically connected and mechanically joined to the outer static conductor element and, between the central part and the peripheral part, an intermediate part joined to the central part and to the peripheral part at locations offset along the circumference of the intermediate part; and a coating placed over the support around the component and over the component directly in contact with the dome.

10. A contact component comprising:

a first static conductor element;

a second static conductor element;

a first electrically conductive dome having a first portion disposed above said second static conductor element;

an insulating annular spacer disposed over said first electrically conductive dome;

a second electrically conductive dome disposed over said insulating annular spacer such that a first portion of said second electrically conductive dome is disposed above said first electrically conductive dome and said second static conductor element;

a flexible conductive element having a central opening therein, said flexible conductive element disposed over said second electrically conductive dome such that at least a portion of said second electrically conductive dome is exposed through the central opening of said flexible conductive element.

11. The contact component as recited in claim 10 wherein:

said first electrically conductive dome has at least three arms radially projecting from the first portion thereof;

said second electrically conductive dome has at least three arms radially projecting from the first portion thereof;

said insulating annular spacer disposed between the first and second electrically conductive domes wherein said insulating annular spacer electrically insulates the first and second domes from one another and wherein in response to a force applied to either of the portions of said first and second domes, said first and second domes comprise at least part of a circuit by which a electrically conductive path is provided between said first and second static conductor elements.

12. A contact component intended to establish electrical continuity under the effect of a mechanical activation and to cancel this continuity elastically in the absence of the mechanical activation, comprising:

an outer static conductor element;

an inner static conductor element;

a first springy metal contact dome intended to connect the static conductor elements temporarily, the dome being in constant and static contact with the outer static conductor element, being fixed to the outer static conductor element, and a second springy metal contact dome in electrical contact with the inner static conductor element; said two domes being positioned on either side of an insulating spacer which insulates the outer peripheral parts of the domes from one another, the central parts of the two domes being distant in the rest position of the domes and in direct contact in their mechanically activated position.

13. The component as claimed in claim 12 wherein the domes comprise a central contact part and a peripheral part comprising at least three arms extending radially from said central contact part, and each of the three arms is fixed to the insulating spacer.

14. The component as claimed in claim 12 wherein at least one dome comprises a single piece cut from a sheet.

15. The component as claimed in claim 12 wherein the outer static conductor element and the inner static conductor element are both formed by printing on an insulating support.

16. The contact component as recited in claim 12 wherein said outer static conductor element has a ring shape and has an opening therein, and said inner static conductor element passes through the opening and terminates in a central portion of said outer ring-shaped static conductor element.

* * * * *